US005692973A

United States Patent [19]

Dalton

[11] Patent Number: 5,692,973

[45] Date of Patent: Dec. 2, 1997

[54] GOLF BALL

[75] Inventor: Jeffrey L. Dalton, North Dartmouth, Mass.

[73] Assignee: Acushnet Company, Fairhaven, Mass.

[21] Appl. No.: 482,525

[22] Filed: Jun. 7, 1995

[51] Int. Cl.[6] ..... A63B 37/06

[52] U.S. Cl. ..... 473/374; 473/377; 473/614; 29/899; 264/241

[58] Field of Search ..... 473/355, 370, 473/371, 372, 373, 374, 375, 376, 377; 273/60 B

[56] References Cited

U.S. PATENT DOCUMENTS

| | | | |
|---|---|---|---|
| 720,852 | 2/1903 | Smith | 473/374 |
| 790,252 | 5/1905 | Du Mahaut | 473/355 |
| 1,482,232 | 1/1924 | Hazeltine | 473/355 X |
| 1,524,171 | 1/1925 | Chatfield | 473/373 |
| 4,660,830 | 4/1987 | Tomar | 273/60 B |

*Primary Examiner*—George J. Marlo
*Attorney, Agent, or Firm*—Pennie & Edmonds

[57] ABSTRACT

This invention relates to an improved golf ball center having a substantially spherical portion and a plurality of protrusions extending outwardly from the spherical portion, the ends of which support the center when it is placed in a spherical mold, and to a mold for injection molding such a golf ball center having first and second mold halves, and for a method of molding a golf ball core by placing a golf ball center into a spherical mold cavity wherein the golf ball center is supported by the protrusions, and filling between the mold cavity and the center.

16 Claims, 8 Drawing Sheets

GOLF BALL

This invention relates to the construction and manufacture of golf balls. In particular, it relates to a structure for supporting the center of a golf ball in a golf ball mold during molding. More particularly, it relates to the arrangement and orientation of protrusions on the surface of the golf ball center capable of holding the center in a concentric position relative to the mold cavity during subsequent molding operations.

Conventionally, golf balls are made by first forming a spherical center, typically solid or liquid filled, and approximately 0.6 to 0.8" in diameter. A concentric spherical "mantle" is formed over this center (the mantle and the center comprise the "core" of the golf ball). The mantle is typically 0.1 to 0.2" thick. A concentric spherical dimpled cover is then formed over the core.

Injection molding is commonly used to form these multilayer golf balls. Typically, the center is placed in a mold cavity and is maintained in a concentric orientation with the mold cavity by retractable or fixed pins extending from the interior walls of the mold to contact the surface of the center. These pins contact the center at a plurality of positions on the center's surface, holding it in the center of the mold cavity. A typical retractable pin mold for molding golf balls is disclosed in U.S. Pat. No. 5,147,657 issued Sep. 15, 1992 to Giza.

Once the mold is closed, liquid mantle material is then injected into the void between the center and the walls of the mold cavity and allowed to solidify. Due to the viscosity of the mantle material and the speed with which it is injected, significant forces push against the center and tend to offset it within the mold cavity. To limit this effect, gates are provided around the periphery of the mold cavity to introduce mantle material from several different directions and thus balance the forces applied to the center. An arrangement of gates is shown in FIG. 1 of U.S. Pat. No. 5,147,657. One drawback to such a mold is that these additional gates increase the mold's cost. Additional gates also require additional finishing work, since the gates leave flashing on the surface of the core that may weaken the mantle surrounding the center unless it is removed. Furthermore, to supply these additional gates, runners must be larger and must be removed from more gate locations, leaving surface imperfections.

Retractable pin molds are also complex, expensive and prone to breakage and wear. Each time a retractable pin mold cycles during molding of the mantle, the pins that support the center are inserted into and retracted from the mold cavity, causing wear around the pin bushings. A means for actuating the retractable pins must be built into a mold, adding to the mold expense. Molten mantle material may become trapped and solidify between the retractable pins and their supporting bushings, requiring mold disassembly and cleaning.

Precise time and temperature control is essential with retractable pin molds. When retractable pin molds are operated, the pins are retracted before the material completely solidifies, allowing the mantle material to collapse and fill the pin holes. When the pins are retracted, however, they can no longer support and properly position the center within the mold cavity. The pins must therefore be removed after the mantle material is fluid enough to fill the holes, yet solid enough to support the golf ball center. If the pins are retracted too soon, the center can shift, producing an unbalanced and unusable ball. If the pins are retracted too late, the mantle material will not fill in the voids left by the pins, or worse, will prevent the pins from being removed. The requirements of precise timing and temperature control also add to the cost of the process. Finishing work may also be required such as removing flashing from the vicinity of each retractable pin.

If fixed pins, rather than retractable pins, are used to support the center during molding of the mantle, the holes left by these fixed pins will remain in the mantle after it is molded and solidified. Depending on the size and orientation of these holes and the extent to which they are filled with plastic during subsequent molding operations (such as molding the cover around the core), the resulting ball may be unbalanced in flight. To reduce potential unbalancing, the number and diameter of the pins are minimized. Even with careful design, however, the amount of mantle material that fills these holes during the next step of the process cannot be accurately controlled. Furthermore, these pins are prone to breakage and require careful handling of the molds.

SUMMARY OF THE INVENTION

A new golf ball core construction has been developed that alleviates many of the problems associated with retractable or fixed pin molding of golf ball cores. In particular, the center is provided with elongated protrusions extending from the surface of the center to stabilize it in the mold cavity. These protrusions allow the elimination of both retractable and fixed pins and the problems and costs inherent with them. Furthermore, the protrusions allow the center to be supported at more points than the retractable pins were typically able to, resulting in golf balls with more accurately positioned centers for better and more consistent golf ball flight characteristics. The added support may also reduce the number of gates required for molding.

The mold for injection molding the center with its protrusions, has two mold halves with hemispherical cavities, for joining together at a mold parting line, and thereby forming a substantially spherical mold cavity. A plurality of indentations are located on the inner surface of the spherical mold cavity for forming the protrusions. In making the golf ball core a center with protrusions is placed into a first hemispherical mold cavity so that the center is supported within the mold cavity by the protrusions. A second mold cavity is registered with the first mold cavity to make a spherical mold cavity. The gap between the center and the spherical cavity is then filled with a mantle material.

DETAILED DESCRIPTION OF THE INVENTION

Figure 1:
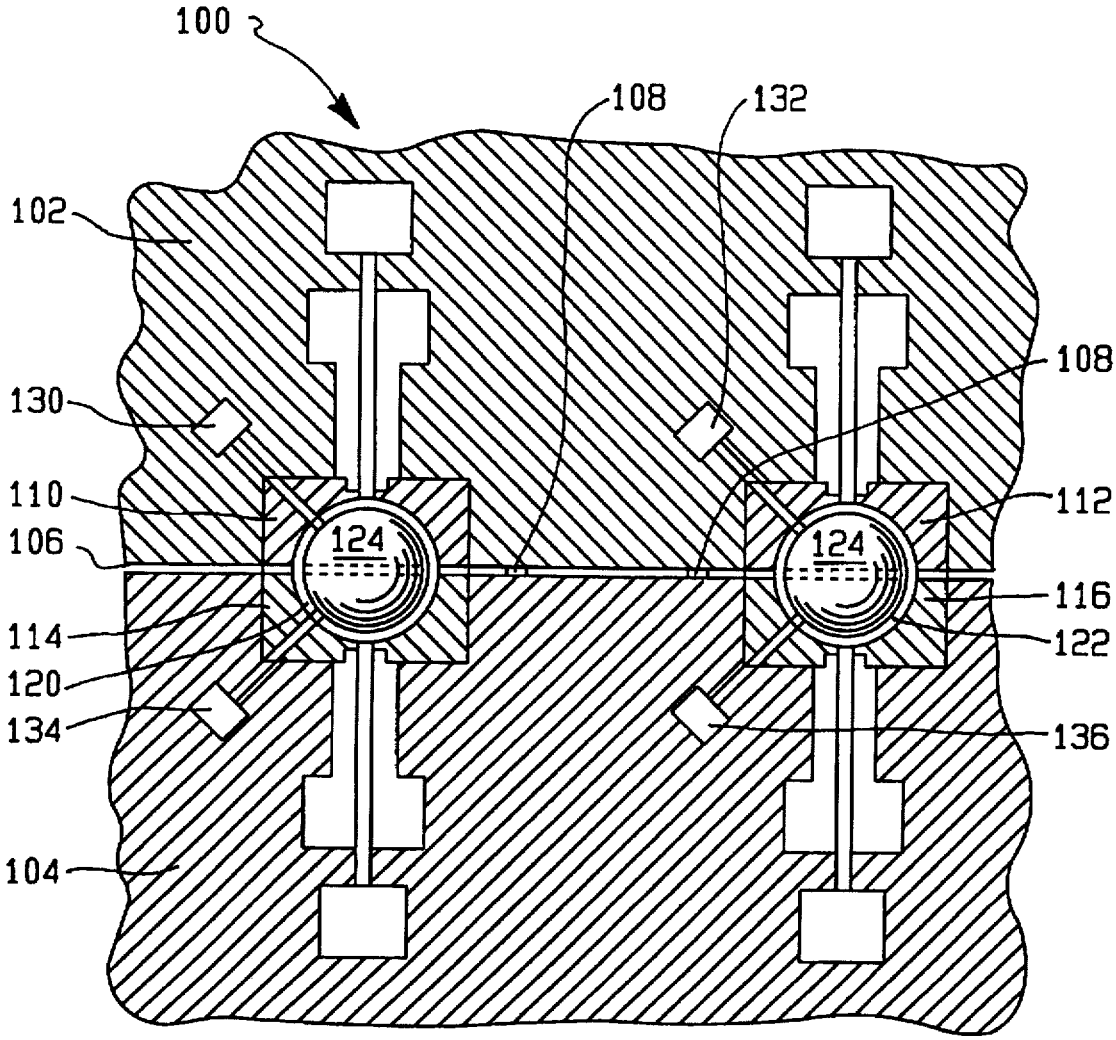
FIG. 1 is a cross-sectional view of a conventional retractable pin mold for golf balls.
Figure 2:
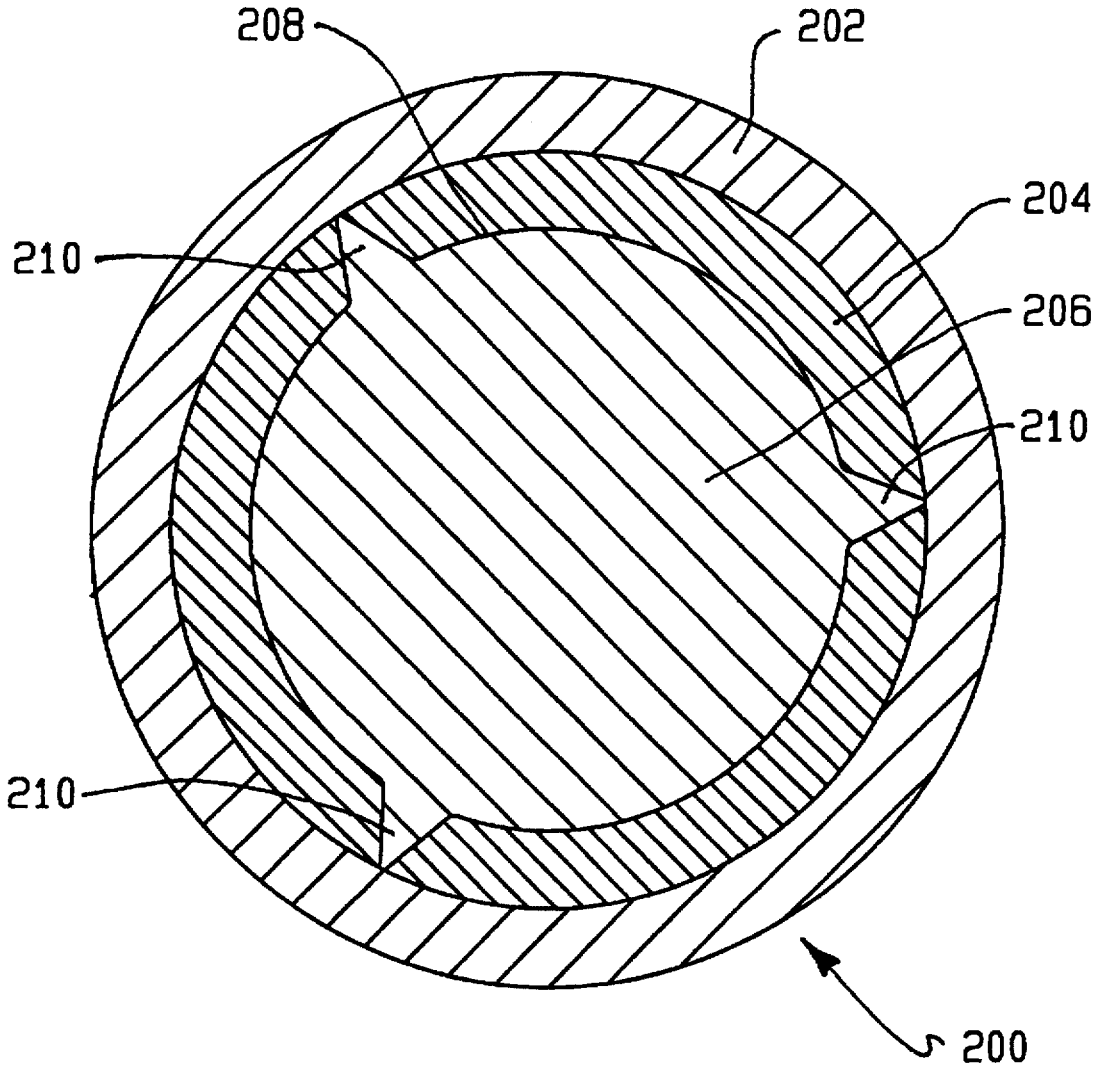
FIG. 2 illustrates a cross-section of a golf ball in accordance with the present invention.

FIG. 1 of this application (which is FIG. 2 in U.S. Pat. No. 5,147,657) is a cross-section of a conventional retractable pin mold showing a portion of mold frame 100' divided into top mold plate 102 and bottom mold plate 104. Stops 108 ensure that a small gap is maintained between the two mold plates to allow for air to escape from the mold cavity. Located in the top of mold plate 102 are top half molds 110 and 112. In bottom mold plate 104 are bottom half molds 114 and 116. The respective half molds 110,114 and 112,116 are in registration and form substantially spherical mold cavities 120 and 122 respectively. The spherical cavities 120,122 have an equatorial parting line 106 which is shown in dashes passing through both. Located in cavities 120 and 122 are golf ball cores 124 and 126, respectively. Associated with each half mold 110,112, 114, and 116 are three retractable pin assemblies. FIG. 1 shows only one such assembly 130, 132, 134, 136, for each half mold. This is an example of one prior art technique for supporting a spherical object inside a spherical mold cavity.

FIG. 2 illustrates a cross-section of a golf ball 200 in accordance with the subject invention. The ball has an outer cover 202 surrounding a core which is comprised of mantle 204 and center 206. The center's surface 208 is substantially spherical, with protrusions 210 extending outwardly therefrom. The protrusions extend equal distances from spherical surface 208. Mantle 204 forms a substantially spherical and concentric layer of constant thickness around center 206. Protrusions 210 extend through the mantle layer, are flush with the surface of the mantle, and contact the inside of the layer surrounding the mantle, which in this example is the inside of cover 202.

Figure 3A:
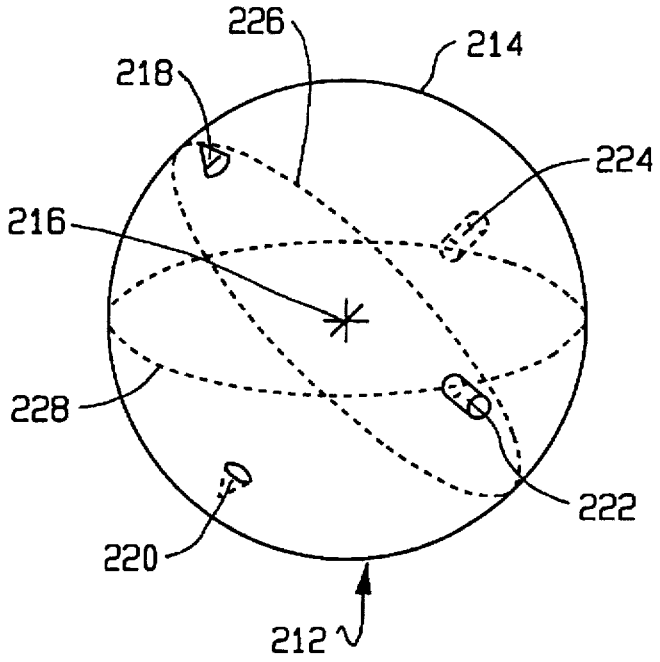
FIG. 3*a* is a perspective view of a golf ball center with elongated protrusions in accordance with the present invention.
Figure 6:
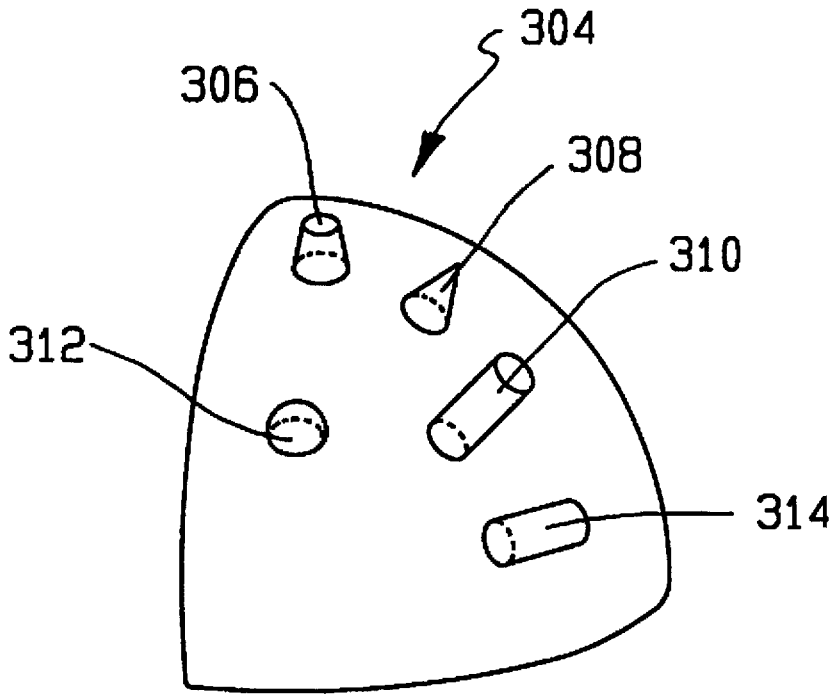
FIG. 6 is a perspective view of several typical protrusion constructions.

As shown in FIG. 3*a*, the center is substantially spherical with a center point 216. Conical protrusions 218,220 and cylindrical protrusions 222,224 extend from the spherical center portion in a spaced apart relationship. Three of these protrusions 218,222,224 are in a triangular relationship and extend from a single hemisphere of center portion 214 as shown by equatorial dashed line 226. The remaining protrusion 220 extends from the surface of the other hemisphere of center portion 214. The protrusions preferably have symmetrical shapes, such as cylinders, cones, truncated cones or hemispheres. Symmetrical shapes will reduce the stress in the mantle layer when the ball is struck. In this embodiment, protrusions 222,224 are cylindrical, providing superior strength and less compressibility and thus reduced shifting of the center in the mold when it is filled. Protrusions 218,220 are substantially conical which advantageously provides for easy release from the mold halves due to their tapering surfaces. The conical and cylindrical protrusion designs can be combined, producing a truncated conical protrusion both easily removed from the mold and having superior strength. A hemispherical protrusion is also preferred since it is more easily manufactured using standard mold cutting tools. These designs are shown more clearly in FIG. 6.

The center is preferably molded using a two piece hemispherical mold, the equatorial parting line of which is shown in FIG. 3*a* as dashed line 228 on the surface of the center. This line passes through protrusions 222,224, indicating that each was partially formed by both center mold halves. Forming protrusions at the parting line of the center mold allows gas to escape as the protrusions are formed, thus assuring the complete filling of the center mold and the complete formation of the protrusions. To prevent air from being trapped in protrusions 218,220, which are located away from the parting line, the mold can be gated at these protrusions, as illustrated below in FIG. 5.

Golf ball centers, such as the one shown in FIG. 3*a*, for example, preferably have diameter of between 0.25" and 4". More preferably, the center diameter may range from 0.75" to 1.65". Most preferably, the center diameter may range from 1.0" to 1.5".

Figure 3B:
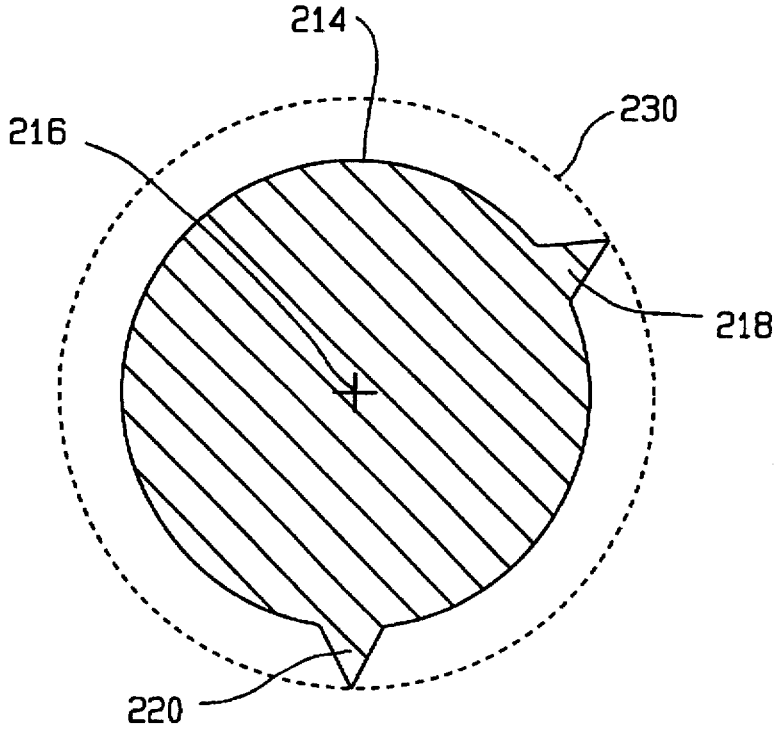
FIG. 3*b* is a cross-sectional view of the golf ball center of FIG. 3*a*.

As shown in FIG. 3*b*, protrusions 218,220,222,224 extend an equal distance above the surface of center 206. Thus, the ends of the protrusions collectively define dashed spherical surface 230 shown in FIG. 3*b*, that is concentric with center 206.

Figure 3C:
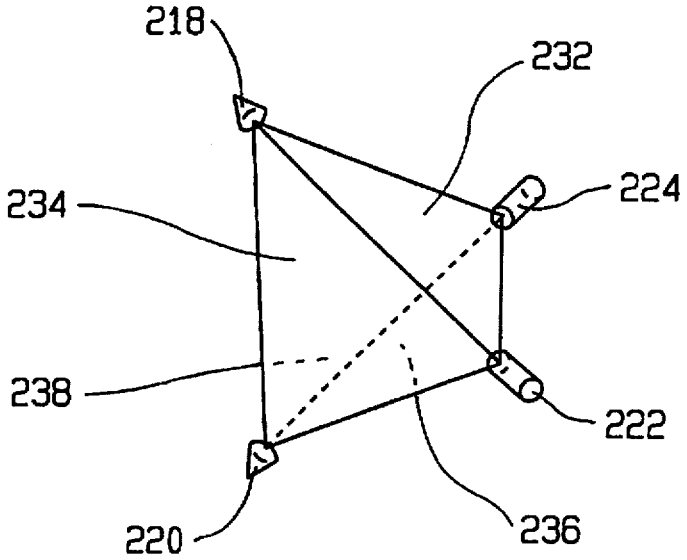
FIG. 3*c* is a perspective view of the four protrusions of the golf ball center of FIG. 3*a* showing their relation to each other.

FIG. 3*c* shows that protrusions 218,220,222,224 collectively define a tetrahedron, as represented by planar surfaces 232,234,236,238. In this example, since the protrusions are evenly spaced, the tetrahedron is regular. Also, as can be seen from the triangular shapes of planar surfaces 232,234, 236,238, the protrusions 218,222,224 are in a triangular relationship with one another.

Figure 3D:
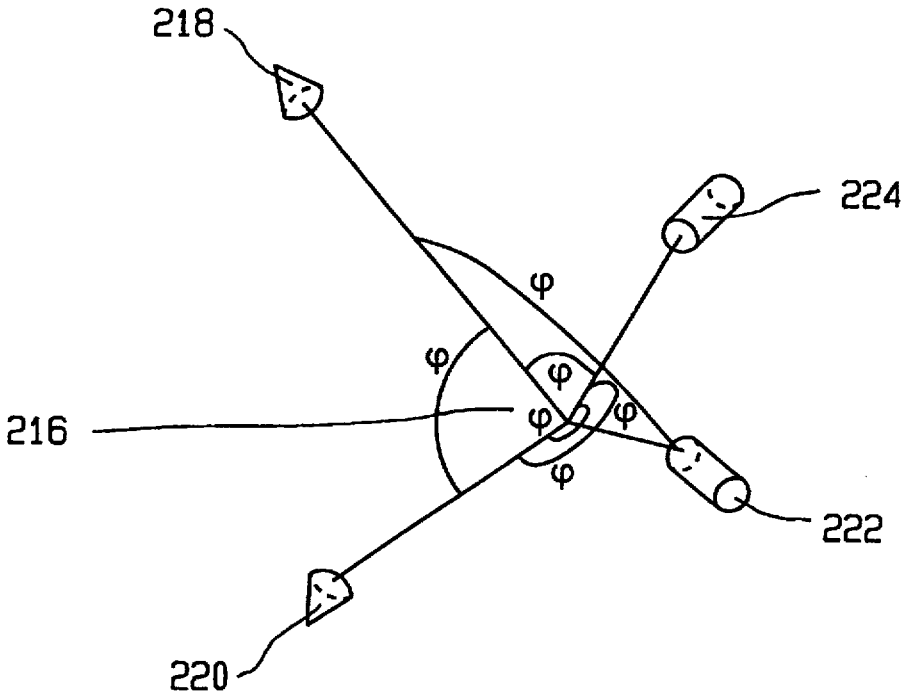
FIG. 3*d* is a perspective view of the four protrusions of the golf ball center of FIG. 3*a* showing their angular relation to each other.

FIG. 3*d* illustrates the preferred spacing of the protrusions. The protrusions should be spaced such that an angle $\phi$ with respect to center point 216 of center 206, at one vertex and adjacent protrusions at the endpoints of the two vectors comprising the angles is between 90 and 120 degrees. An angle $\phi$ of 100 to 115 degrees is preferred. An angle $\phi$ of 108 degrees (shown here) is most preferred.

Figure 3E:
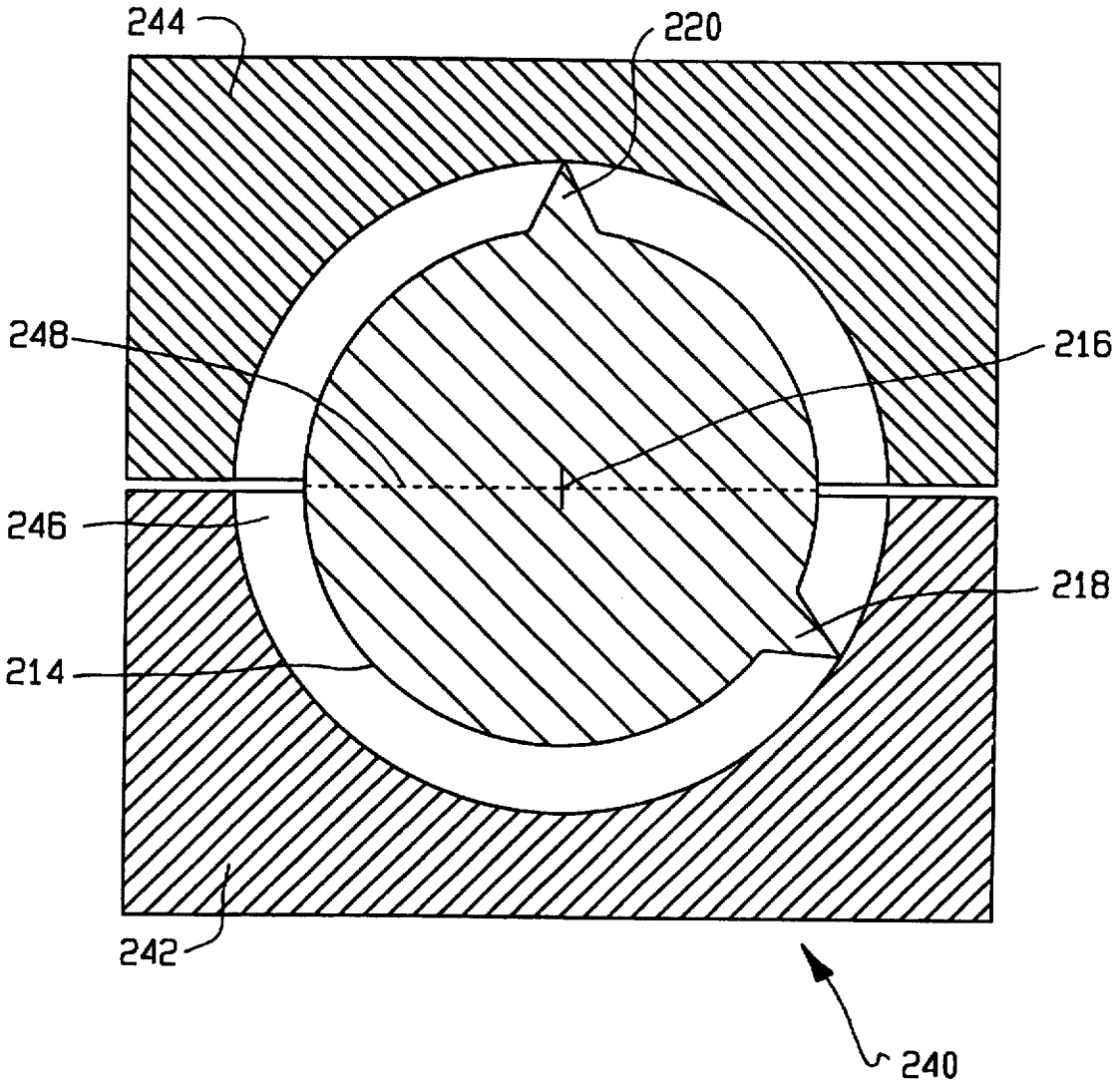
FIG. 3*e* is a cross-sectional view of the golf ball center of FIG. 3*a* placed in a mold for molding an outer mantle layer around the center.

FIG. 3*e* shows the golf ball center in mantle mold 240. The mold is made of two mold halves 242,244, each having a substantially hemispherical mold cavity. These hemispherical mold cavities when joined together form a substantially spherical mold cavity 246 when in proper registration. The two mold halves join at a parting line here shown as dashed line 248. Three protrusions 218,222,224, previously identified in FIGS. 3*a–d*, extend from the lower hemisphere of the center portion 214 and contact the inner surface of the spherical cavity 246 (protrusions 222,224 are not shown in this figure). A fourth protrusion 220, previously shown in FIGS. 3*a–d*, extends upward from the opposing hemisphere of center portion 214 and contacts the inner surface of mold half 244. The result of this three protrusion placement in the lower mold is that the center automatically centers itself when placed in the lower mold cavity in any orientation, as long as it rests on three protrusions touching the interior of the lower mold. The center is held in this centered position by the fourth protrusion 220 which touches the upper mold half 244 when the upper mold 244 is brought into proper registration and contact with the lower mold 242. This self-centering feature enables a machine operator to rapidly fill many mold cavities with centers, knowing that each center will be properly centered when the mold is closed as long as each center rests on at least three protrusions in the lower mold half.

Figure 4:
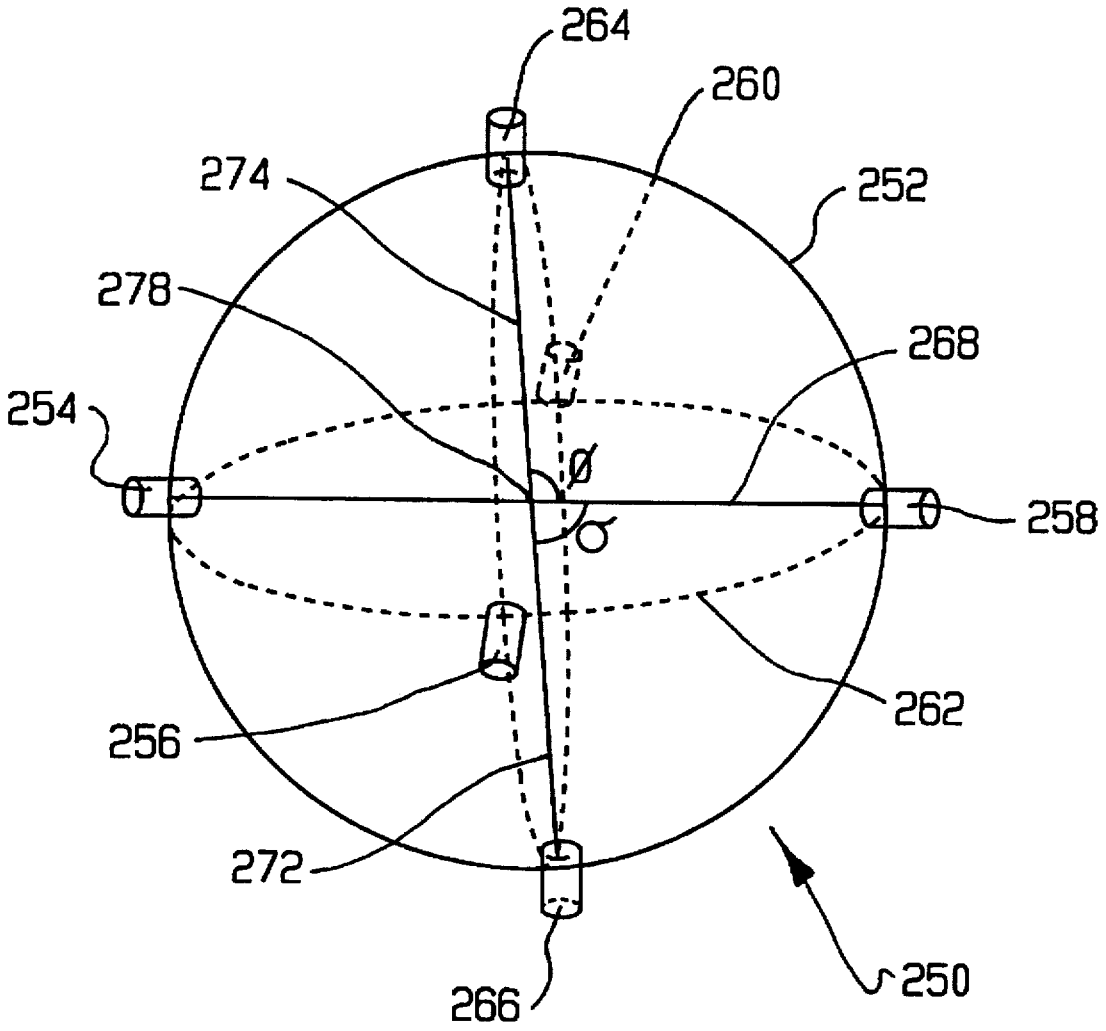
FIG. 4 is a perspective view of an alternative embodiment of a golf ball center that has six protrusions.

FIG. 4 shows an alternative embodiment of the invention incorporating 6 spaced apart cylindrical protrusions extending from golf ball center 250. The protrusions extend from the substantially spherical surface 252 of center 250. Four of these protrusions 254,256,258,260 are located along the equatorial parting line of the mold that created the center, here shown as dashed line 262. Two additional protrusions 264,266 extend from the center from points away from the parting line. Protrusion 266 forms an angle a between a radius line 268 extending from the center point 278 of the center to parting line 262 and a radius line 272 extending from the center point 278 to protrusion 266. Protrusion 264 forms an angle $\phi$ between a radius line 268 extending from the center point 278 of the center to parting line 262 and a radius line 274 extending from the center point 278 to protrusion 264. Both angles are preferably at least 65 degrees. More preferably, they are at least 80 degrees. Most preferably, they are 90 degrees, as shown here. The protrusions extending from spherical surface 252 of center 250 along parting line 262 are preferably equally spaced apart. In this embodiment, with four protrusions at the parting line, this spacing would be ¼ of the circumference, or an angle of 90 degrees as measured from the center point of the center. The six protrusions provide superior support for the center when it is held in the golf ball core mold for molding the mantle about the center. If lesser force is needed to keep the center centered in the golf ball core mold, three protrusions can be utilized along the parting line, preferably evenly spaced apart.

The embodiment disclosed in FIG. 4 provides an added advantage of special benefit in the manufacture of golf balls. Due to the small size of the balls and high production of golf ball manufacture, the molds are rapidly filed with centers, molded, and emptied. To do this, the centers must be rapidly and accurately placed in the hemispherical lower mold halves and should self-center with respect to the these molds regardless of their angular orientation with respect to the lower mold half. FIG. 3*e* discloses a four protrusion center that will self-center as long as three protrusions are placed in the lower mold. This may require some special manipulation by the mold operator, however. With six protrusions equally spaced about surface 252, such as shown in FIG. 4, no manipulation is required. The FIG. 4 embodiment will self-center when placed in the lower mold half regardless of the center's angular orientation with respect to the lower mold.

Figure 5:
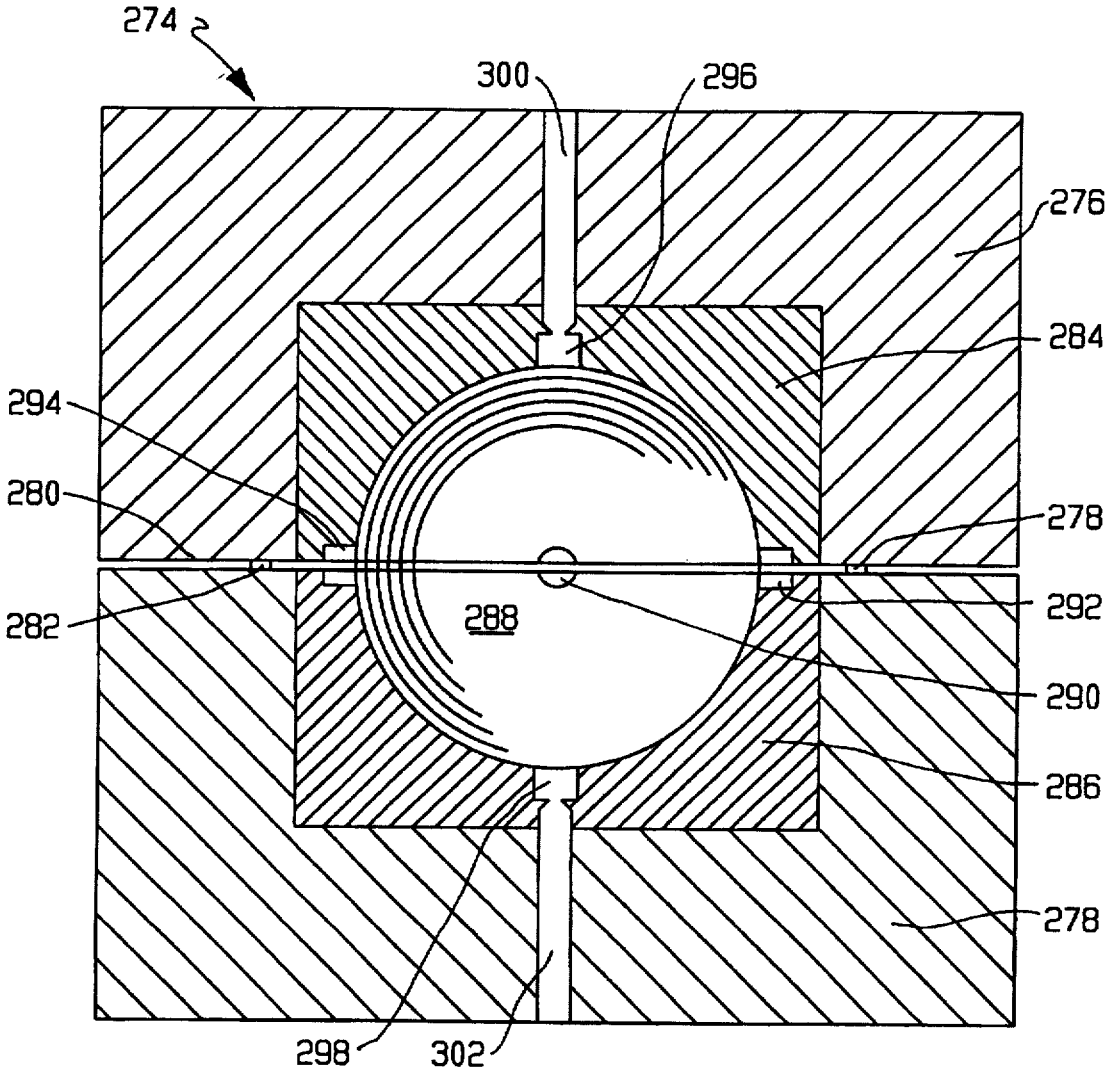
FIG. 5 illustrates a cross-section of a golf ball center mold in accordance with the present invention.

FIG. 5 shows a cross-section of a center mold used to make the golf ball center of FIG. 4 in accordance with the present invention. Mold frame 274 is divided into top mold plate 276 and bottom mold plate 278. The two mold plates join at parting line 280. Stops 282 ensure that a small gap is maintained between the two mold plates to allow air to escape from the mold cavity. Such a gap leaves only a witness line along the equator of the core rather than a thick band of center stock that would otherwise need to be removed in an additional manufacturing step.

Top half mold 284 is located in top mold plate 276. Bottom half mold 286 is located in bottom mold plate 278. The half molds are in registration and form a substantially spherical mold cavity 288 with four cylindrical indentations (only 290,292,294 are shown in this view) equally spaced along the parting line that are formed by both the top and bottom mold halves. These indentations are filled with center material during the molding process and form the center's protrusions. By molding the protrusions along the parting line, gas that otherwise might be entrapped in these indentations is allowed to escape along the parting line. Spherical cavity 288 has two other cylindrical indentations 296,298 extending into the top and the bottom of the mold cavity, respectively, for forming two additional center protrusions. Runners 300,302 joined to protrusions 296,298, respectively, are used to inject the center stock into the mold cavity. Injecting plastic into the mold cavity via indentations located away from the parting line reduces the risk that gas will be entrapped in these indentations during the molding process. Such a gate design is shown in FIG. 5 of U.S. Pat. No. 5,147,657.

I claim:

1. A golf ball comprising a cover and a center, wherein said center comprises an outer substantially spherical surface having a first and a second hemisphere and four protrusions extending equal distances outwardly from said spherical surface, said protrusions being positioned in a spatial relationship wherein their ends collectively define a support for said center such that said center is self-centering when placed in a mold cavity during the manufacture of said golf ball, wherein three of the protrusions are in triangular relation to one another and extend from said first hemisphere and the forth protrusion extends from said second hemisphere.

2. The golf ball of claim 1, wherein said protrusions have shapes selected from the group consisting of a cone, a truncated cone, a cylinder, and a hemisphere.

3. The golf ball of claim 1, wherein the endpoints of said protrusions define a tetrahedron.

4. The golf ball of claim 3, wherein said tetrahedron is regular.

5. The golf ball of claim 1 which further comprises a mantle having an outer surface surrounding said center.

6. The golf ball of claim 5 wherein said protrusions extend through said mantle to said outer surface of said mantle.

7. The golf ball of claim 6, wherein said mantle and said center are concentric.

8. The golf ball of claim 7, wherein said outer surface of said mantle is substantially spherical.

9. The golf ball of claim 1, wherein:

(a) each protrusion forms a vector from its endpoint through the center point of the core; and (b) each of the vectors formed by the protrusions in said first hemisphere and the vector formed by the fourth protrusion in the second hemisphere form an angle of about 90 to about 120 degrees.

10. The golf ball of claim 9, wherein the angle between said vectors is about 100 to about 115 degrees.

11. The golf ball of claim 9, wherein the angle between said vectors is about 108 degrees.

12. A golf ball comprising a cover, a center and a mantle layer disposed between the cover and the center, wherein:

(a) said center comprises an outer substantially spherical surface having a first and a second hemisphere and four protrusions extending equal distances outwardly from said spherical surface;

(b) said protrusions being positioned in a spatial relationship wherein their ends collectively define a support for said center such that said center is self-centering when placed in a mold cavity during the manufacture of said golf ball, wherein three of the protrusions are in triangular relation to one another and extend from said first hemisphere and the forth protrusion extends from said second hemisphere; and (c) said mantle layer has an outer surface surrounding said center.

13. The golf ball of claim 12, wherein the endpoints of said protrusions define a tetrahedron.

14. The golf ball of claim 12, wherein:

(a) each protrusion forms a vector from its endpoint through the center point of the core; and (b) each of the vectors formed by the protrusions in said first hemisphere and the vector formed by the fourth protrusion in the second hemisphere form an angle of about 90 to about 120 degrees.

15. The golf ball of claim 14, wherein the angle between said vectors is about 100 to about 115 degrees.

16. The golf ball of claim 14, wherein the angle between said vectors is about 108 degrees.

* * * * *